US009470180B2

(12) United States Patent
Saito et al.

(10) Patent No.: US 9,470,180 B2
(45) Date of Patent: Oct. 18, 2016

(54) CYLINDER HEAD COVER OF INTERNAL COMBUSTION ENGINE

(71) Applicant: MAHLE FILTER SYSTEMS JAPAN CORPORATION, Tokyo (JP)

(72) Inventors: Takanobu Saito, Soka (JP); Masanori Suto, Kawagoe (JP); Satoshi Arakawa, Kawagoe (JP)

(73) Assignee: MAHLE FILTER SYSTEMS JAPAN CORPORATION, Tokyo (JP)

( * ) Notice: Subject to any disclaimer, the term of this patent is extended or adjusted under 35 U.S.C. 154(b) by 66 days.

(21) Appl. No.: 14/187,645

(22) Filed: Feb. 24, 2014

(65) Prior Publication Data

US 2014/0238331 A1 Aug. 28, 2014

(30) Foreign Application Priority Data

Feb. 27, 2013 (JP) ..... 2013-036611

(51) Int. Cl.

| | |
|---|---|
| ***F02B 77/00*** | (2006.01) |
| ***F02F 1/42*** | (2006.01) |
| ***F02B 77/04*** | (2006.01) |
| ***F02F 7/00*** | (2006.01) |
| *F01M 13/04* | (2006.01) |

(52) U.S. Cl.

CPC ..... *F02F 7/006* (2013.01); *F01M 13/0416* (2013.01)

(58) Field of Classification Search

CPC ..... F02F 1/24; F02B 77/13; F02B 63/02; F02M 35/024; F01M 11/004

USPC ..... 123/195 C, 198 E, 195 R, 193.5, 572

See application file for complete search history.

(56) References Cited

U.S. PATENT DOCUMENTS

| | | | | |
|---|---|---|---|---|
| 4,498,433 A | | 2/1985 | Ogawa | |
| 4,721,090 A | * | 1/1988 | Kato | F01L 1/0532 123/41.86 |
| 4,993,375 A | * | 2/1991 | Akihiko | F01M 13/0416 123/195 C |
| 5,129,371 A | * | 7/1992 | Rosalik, Jr. | F01M 13/0416 123/41.86 |

FOREIGN PATENT DOCUMENTS

| | | |
|---|---|---|
| CH | 517 250 A | 12/1971 |
| DE | 20 2005 004 259 U1 | 7/2006 |
| FR | 2 456 854 | 12/1980 |
| JP | 2002-292695 A | 10/2002 |

(Continued)

OTHER PUBLICATIONS

European Extended Search Report, Sep. 5, 2014, 5 pages.

(Continued)

*Primary Examiner* — Lindsay Low
*Assistant Examiner* — Syed O Hasan
(74) *Attorney, Agent, or Firm* — Foley & Lardner LLP

(57) ABSTRACT

A resin-made molded cylinder head cover, which is light in weight and relatively thin particularly at a flange part thereof comprises a cover part that is rectangular in shape and has a plurality of plug holes aligned in a longitudinally extending center area of the cover part; a flange part that is integral with and extends around a periphery of the cover part, so that the cylinder head cover is shaped like a rectangular shallow dish; and thicker elongate bead portions that are integral with the cover part and extend respectively along laterally opposed sides of the longitudinally extending center area, each bead portion being thicker than a general area of the cover part.

18 Claims, 10 Drawing Sheets

(56) References Cited

FOREIGN PATENT DOCUMENTS

| | | | |
|---|---|---|---|
| JP | 2007-154812 | A | 6/2007 |
| JP | 2011-58433 | A | 3/2011 |

OTHER PUBLICATIONS

Chinese Office Action, Application No. 201410065780.8, Feb. 3, 2016, 13 pages.

* cited by examiner

CYLINDER HEAD COVER OF INTERNAL COMBUSTION ENGINE

BACKGROUND OF THE INVENTION

1. Field of the Invention

The present invention relates in general to cylinder head covers of an internal combustion engine and more particularly to the cylinder head covers of a type that is constructed of resin. More specifically, the present invention is concerned with a cylinder head cover of resin which exhibits a satisfied mechanical strength irrespective of a thinner wall and light-weight construction thereof.

2. Description of the Related Art

In order to clarify the present invention, one conventional cylinder head cover of the above-mentioned type, namely, the resin-made molded cylinder head cover disclosed in Japanese Laid-open Patent Application (tokkai) 2007-154812 will be briefly described.

The cylinder head cover disclosed by the above-mentioned publication comprises a thinner cover part that is rectangular in shape and a flange part that is integrally formed around a lower peripheral portion of the thinner cover part and has a thickness larger than that of the thinner cover part. The flange part is integrally formed at mutually spaced positions with a plurality of bolt boss portions each being cylindrical in shape. When in use, the flange part of the cylinder head cover is put on a cylinder head of an internal combustion engine having a rectangular (or rectangularly extending) gasket intimately put therebetween and a plurality of connecting bolts passing through the bolt boss portions are used to tightly fix the cylinder head cover to the cylinder head. Usually, cylinder head covers of the above-mentioned type are constructed of glass fiber-reinforced polyamide resin or the like.

As is mentioned hereinabove, the flange part of the cylinder head cover of the above-mentioned publication is formed thicker than the cover part. This is because of need of increasing the mechanical strength of the flange part to which a remarkably large force is applied from the connecting bolts at the time when the bolts are turned for fixing the cylinder head cover to the cylinder head of the engine. If the cylinder head covers are of a type that has a gasket receiving groove at a lower surface of the thicker flange part, the thickness of the flange part needs to increase more by a degree corresponding to a mechanical strength that would be lost due to presence of the gasket receiving groove.

Due to the above-mentioned reasons, it has been difficult to sufficiently reduce the thickness of the flange part of the cylinder head cover and weight of an entire construction of the cylinder head cover.

SUMMARY OF THE INVENTION

When considering and analyzing the construction of the cylinder head cover of the publication, the inventors have found out that due to an inevitable construction of the cylinder head cover, there is room for much more effectively reducing the thickness of the flange part and weight of the entire construction of the cylinder head cover without sacrificing the mechanical strength of the same.

If reduction of thickness of the flange part and reduction of a cross sectional area of the flange part are simply made without deeply considering and evaluating a resin-made molded cylinder head cover with respect to the relationship between the structure and dynamic property, molding defects caused by short-shot (viz., insufficient filling of melted resin in a desired cavity portion) and the like, tend to occur. The short-shot means a phenomenon in which a resin in a melted condition fails to flow to terminal cavity portions of a molding die.

This is because the fluidity of melted resin in the cavity of the molding die (viz., the property of the melted resin to be moved a desired portion of the cavity) depends largely on a size or thickness of a cavity portion of the molding die in which the flange part is molded. Thus, if the size or thickness of the cavity portion is insufficient to obtain a desired fluidity of melted resin, undesired short-shot tends to occur.

The present invention is provided by taking the above-mentioned phenomena into consideration and aims to provide a resin-made molded cylinder head cover which can avoid the short-shot, assure reduction of cross sectional area of the flange part, assure reduction of thickness of the flange part and contribute to reduction of weight of an entire construction of the cylinder head cover by adding only a simple improvement to the shape of the cylinder head cover.

According to a first aspect of the present invention, there is provided a resin-made molded cylinder head cover (1A, 1B) for an internal combustion engine, which comprises a cover part (2) that is rectangular in shape, the cover part (2) having a plurality of plug holes (8) aligned in a longitudinally extending center area of the cover part (2); a flange part (3) that is integral with and extends around a periphery of the cover part (2), so that the cylinder head cover (1A, 1B) is shaped like a rectangular shallow dish; and thicker elongate bead portions (12*a*, 12*b*), (22, 12*c*) that are integral with the cover part (2) and extend respectively along laterally opposed sides of the longitudinally extending center area, each bead portion being thicker than a general area of the cover part (2).

According to a second aspect of the present invention, there is provided a resin-made molded cylinder head cover (1A) for an internal combustion engine, which comprises a cover part (2) that is rectangular in shape, the cover part having a plurality of plug holes (8) aligned in a longitudinally extending center area of the cover part (2); a flange part (3) that is integral with and extends around a periphery of the cover part (2), so that cylinder head cover (1A) is shaped like a rectangular shallow dish; a plurality of reinforcing ribs (10, 11, 11') that are integrally formed on an inner surface of the cover part; and thicker elongate bead portions (12*a*, 12*b*) that are integral with the cover part (2) and extend respectively along laterally opposed sides of the longitudinally extending center area, each bead portion being thicker than a general area of the cover part (2), which is characterized in that the thicker elongate bead portions (12*a*, 12*b*) are projected elongate portions that are entirely formed on the inner surface of the cover part (2) and integrally connected to the reinforcing ribs.

According to a third aspect of the present invention, there is provided a resin-made molded cylinder head cover (1B) for an internal combustion engine, which comprises a cover part (2) that is rectangular in shape, the cover part (2) having a plurality of plug holes (8) aligned in a longitudinally extending center area of the cover part; a flange part (3) that is integral with and extends around a periphery of the cover part (2), so that cylinder head cover (1B) is shaped like a rectangular shallow dish; a plurality of reinforcing ribs (10, 11, 11') that are integrally formed on an inner surface of the cover part (2); and thicker elongate bead portions (22, 12*c*) that are integral with the cover part (2) and extend respectively along laterally opposed sides of the longitudinally extending center area, each bead portion being thicker than a general area of the cover part, which is characterized in that one of the thicker elongate bead portions is a projected elongate portion (12*c*) that is entirely formed on the inner surface of the cover part and integrally connected to the reinforcing ribs, and another one (22) of the thicker elongate bead portions comprises a first projected elongate section (22*a*, 22*c*) formed on the inner surface of the cover part and a second projected elongate section (22*b*, 22*d*) formed on an outer surface of the cover part (2).

BRIEF DESCRIPTION OF THE DRAWINGS

Other objects and advantages of the present invention will become apparent from the following description when taken in conjunction with the accompanying drawings, in which.

DETAILED DESCRIPTION OF THE EMBODIMENTS

Figure 1:
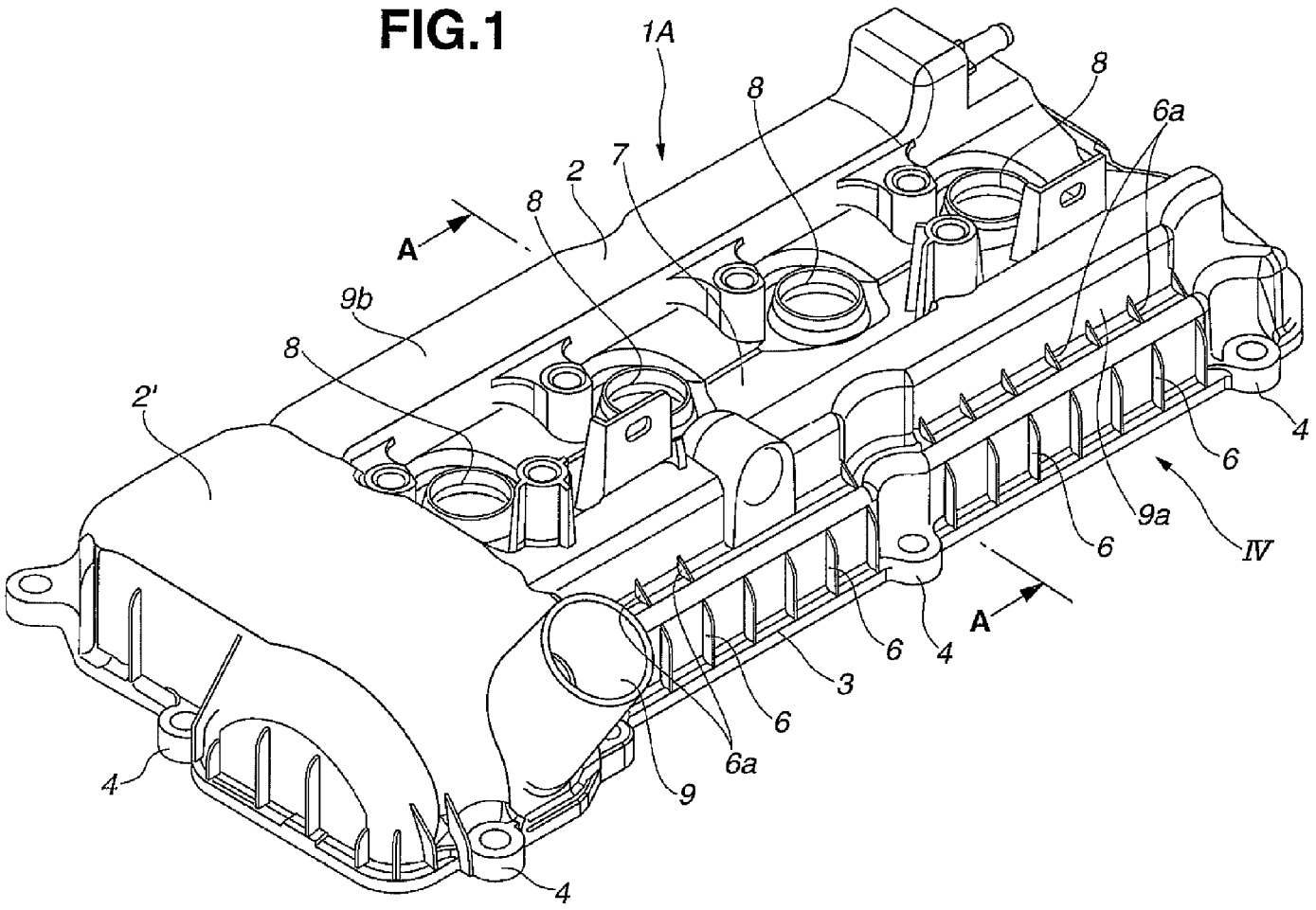
FIG. 1 is a perspective view of a resin-made molded cylinder head cover of a first embodiment of the present invention.
Figure 2:
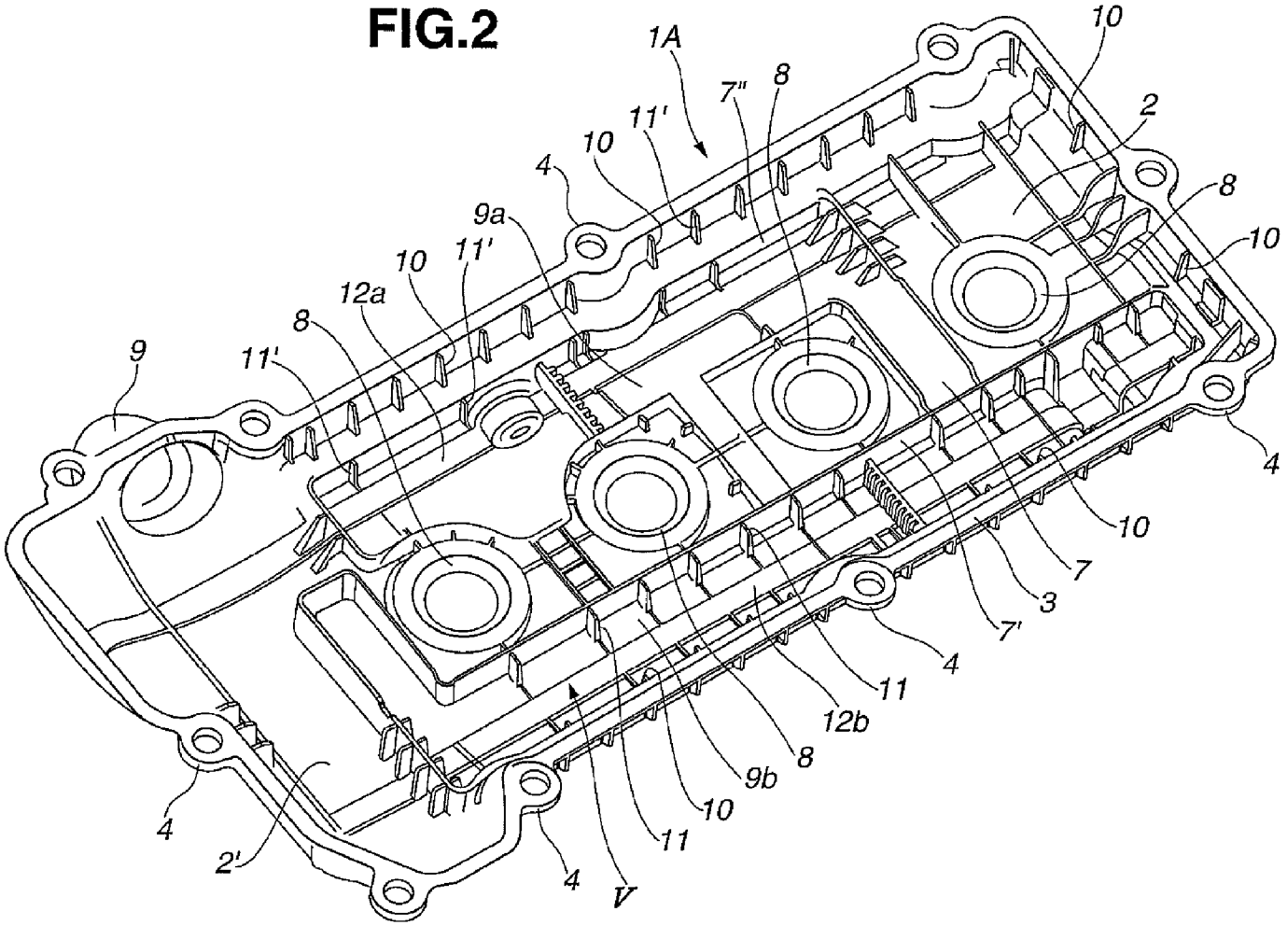
FIG. 2 is a bottom perspective view of the cylinder head cover of the first embodiment.

Referring to FIGS. 1 to 5, particularly FIGS. 1 and 2, there is shown a resin-made molded cylinder head cover 1A of a first embodiment of the present invention.

The cylinder head cover 1A is constructed of a heat-resistant thermoplastic resin, such as glass-fiber reinforced polyamide resin (for example, Nylon 66 (registered trade name)) or the like.

Figure 3:
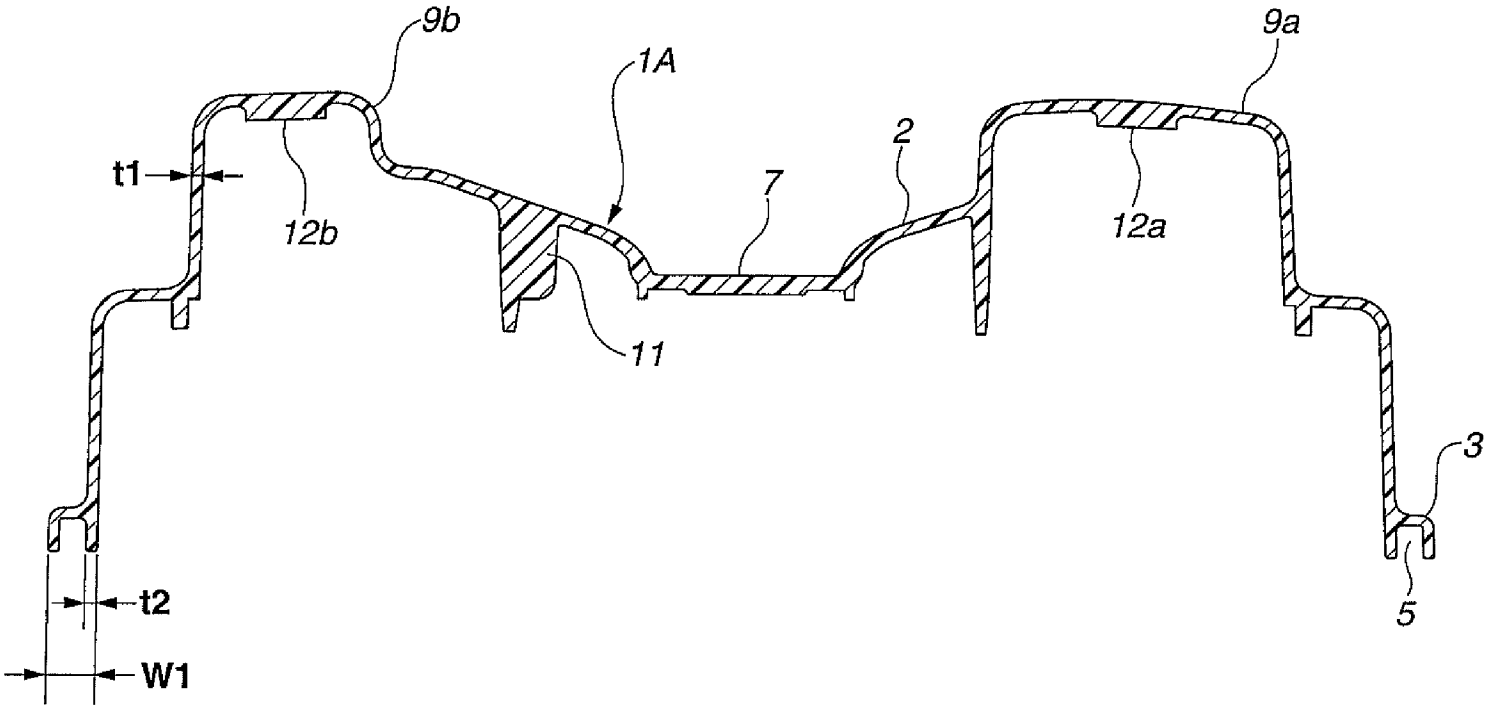
FIG. 3 is an enlarged sectional view taken along the line "A-A" of FIG. 1.

As will be understood from FIGS. 1 to 3, the cylinder head cover 1A is shaped like a rectangular deep dish, which generally comprises a major cover part 2 that is rectangular in shape and sized to fully cover both an upper portion of a cylinder head (not shown) of an internal combustion engine and a camshaft driving mechanism (not shown) of the engine, and a flange part 3 that is integrally and entirely formed around a downwardly projected end of the cover part 2.

As is seen from FIG. 3, a thicker lower portion of the flange part 3 has a thickness of "W1". In the drawings, a swollen portion of the cover part 2 that covers an input section of the camshaft driving mechanism of the engine is denoted by numeral 2'.

As is seen from FIG. 1, the flange part 3 is formed therearound with a plurality of bolt boss portions 4 each having an opening (no numeral) formed therethrough. As shown, each bolt boss portion 4 has a semi-cylindrical lower part that is projected laterally outward from an outer surface of the flange part 3. As will be understood from FIG. 1, when it is intended to mount the cylinder head cover 1A onto the cylinder head (not shown) of the engine, corresponding number of connecting bolts (not shown) are inserted into the bolt boss portions 4, engaged with threaded bolt holes (not shown) possessed by the cylinder head and turned in a fastening direction. With this process, the cylinder head cover 1A is tightly and properly mounted onto the cylinder head of the engine.

Figure 5:
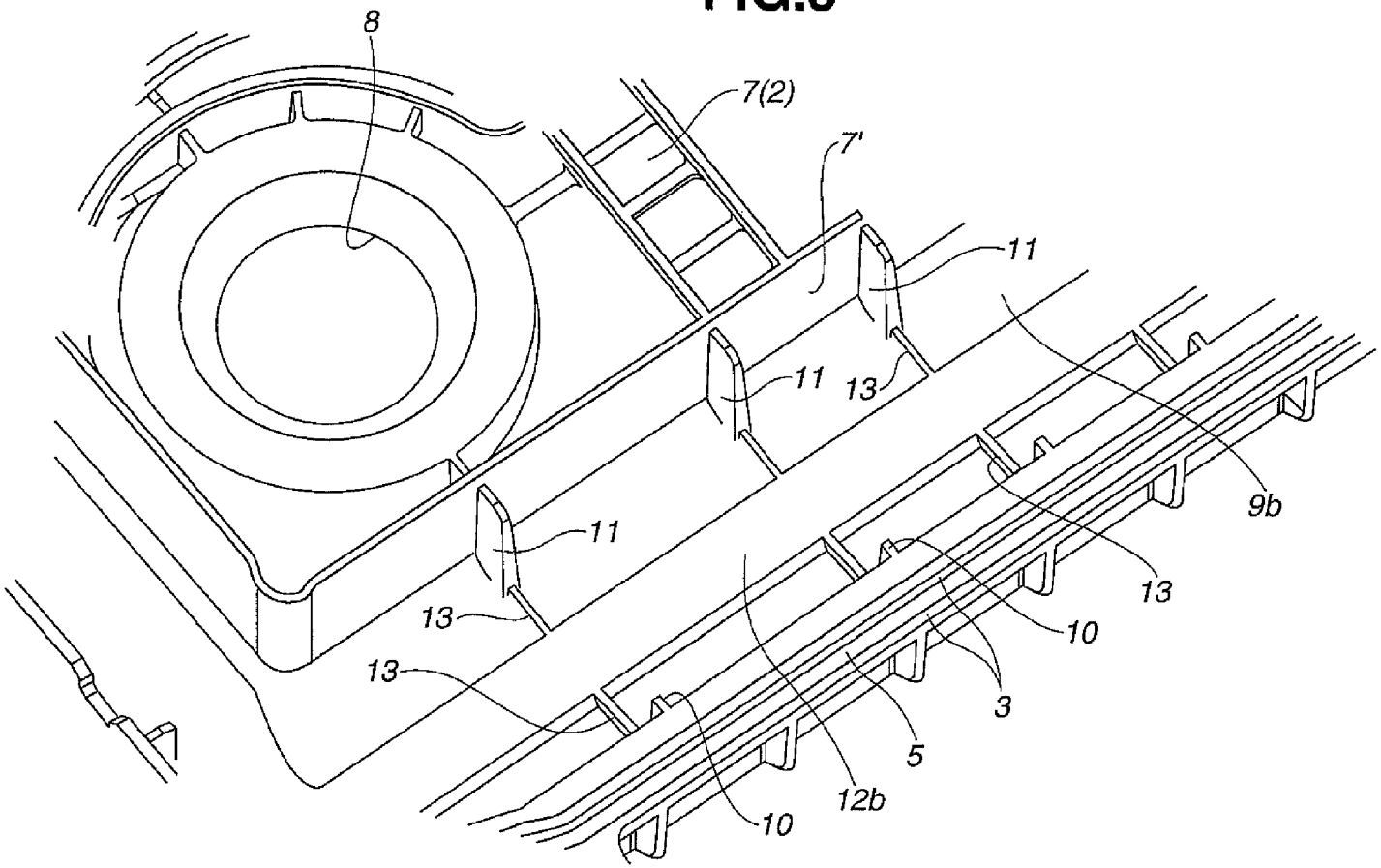
FIG. 5 is an enlarged perspective view of a part indicated by an arrow "V" of FIG. 2.

As is seen from FIGS. 3 and 5, the thicker lower portion of the flange part 3 is formed at a lower base end with a gasket receiving groove 5 for tightly receiving therein a rectangular (or rectangularly extending) gasket (not shown). It is to be noted that the gasket receiving groove 5 is not shown in FIG. 2 for simplification of the drawing.

Figure 4:
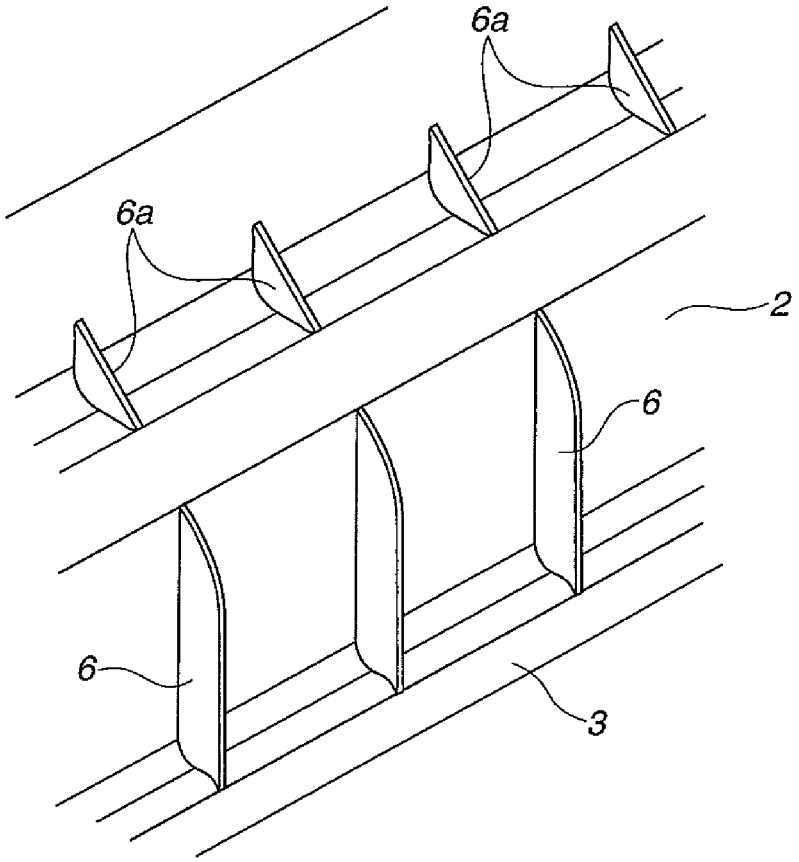
FIG. 4 is an enlarge perspective view of a part indicated by an arrow "IV" of FIG. 1.

As is seen from FIGS. 1 and 4, the flange part 3 is integrally formed therearound with a plurality of reinforcing ribs 6 each extending vertically, as shown. Furthermore, the flange part 3 is integrally formed with a plurality of small reinforcing ribs 6*a* above the reinforcing ribs 6.

As is seen from FIGS. 1 and 3, the rectangular cover part 2 of the cylinder head cover 1A is formed with a rectangular center portion 7 that is depressed, and as is seen from FIGS. 1 and 2, the rectangular depressed center portion 7 is formed with a plurality (viz., four in the illustrated embodiment) of plug holes 8 that are aligned at a given pitch. When in use, each plug hole 8 puts therein an ignition plug (not shown) tightly.

As is seen from FIGS. 1 and 2, the swollen portion 2' of the cylinder head cover 1A is formed at one lateral end thereof with an oil filler pipe 9 that is inclined.

As is seen from FIGS. 1, 2 and 3, the cylinder head cover 1A is formed at both sides of the rectangular center portion 7 with respective tunnel portions 9*a* and 9*b* that are shaped and sized to put therein two cam shafts (not shown) of the valve driving mechanism respectively.

As is seen from FIGS. 2 and 5, on an inner surface of the cylinder head cover 1A, there are integrally formed a plurality of reinforcing ribs 10 that are arranged to form a line along the longitudinal direction of the flange part 3, as shown, and further more, there are integrally formed a plurality of reinforcing ribs 11 on a wall 7' that defines one lateral side of the rectangular depressed center portion 7 of the cylinder head cover 1A. Furthermore, as is seen from FIG. 2, on another wall 7" that defines the other lateral side of the rectangular depressed center portion 7 of the cover 1A, there are integrally formed a plurality of reinforcing ribs 11', as shown.

As is seen from FIG. 2, in addition to the above-mentioned reinforcing ribs 10, 11 and 11', various ribs (no numerals) are integrally formed on the cylinder head cover 1A for the purpose of increasing the mechanical strength of the cylinder head cover 1A.

As is seen from FIGS. 2, 3 and 5, particularly FIG. 2, the inner surface of the cylinder head cover 1A is formed, along the opposed sides of the rectangular depressed center portion 7, with first and second elongate bead portions (or belt-like portions) 12*a* and 12*b* that extend in a longitudinal direction of the cylinder head cover 1A. Each of these bead portions 12*a* and 12*b* has substantially the same thickness throughout the entire length thereof.

More specifically, as is seen from FIGS. 2 and 3, particularly FIG. 3, the first elongate bead portion 12*a* is integrally formed on a center of a ceiling of the tunnel portion 9*a* and extends longitudinally along the same, and the second elongate bead portion 12*b* is integrally formed on a center of a ceiling of the other tunnel portion 9*b* and extends longitudinally along the same.

It is to be noted that as is seen from FIG. 3, the first and second elongate bead portions 12*a* and 12*b* are thicker than a general part of the cylinder head cover 1A. Indicated by numeral 11 in FIG. 3 is a vertically sectioned view of one of the reinforcing ribs 11, which is taken when the cylinder head cover 1A is cut along the line "A-A" of FIG. 1.

It is to be noted that, as is understood from FIG. 3, even a width dimension "W1" of the thicker lower portion of the flange part 3 is larger than the thickness "t1" of the general part of the cylinder head cover 1A, the thickness "t2" of a base part of the thicker lower portion is substantially the same as the thickness "t1" of the general part.

As will be understood from FIGS. 2 and 5, the second elongate bead portion 12*b* is integrally connected to the reinforcing ribs 11 and the thicker lower portion of the flange part 3 through a plurality of small ribs 13. Similar to this, as will be seen from FIG. 2, the first elongate bead portion 12*a* is integrally connected to the reinforce ribs 11' and inner walls (no numeral) surrounding the plug holes 8, through a plurality of small ribs (no numeral).

Although the first and second elongate bead portions 12*a* and 12*b* extend straight as is seen from FIG. 2, these bead portions 12*a* and 12*b* may have curved portions so long as they keep a continuity in a longitudinal direction.

In the following, a process of producing the cylinder head cover 1A through a so-called injection molding will be described.

A split molding die (not shown) is prepared that is able to define therein a cavity having the same shape as a product (viz., the cylinder head cover 1A) when properly assembled. The molding die has an injection gate for example at a position that would face one short side of the product (viz., the cylinder head cover 1A) when a resin injected into the cavity is sufficiently hardened. The injection gate may be provided at different positions.

After the split molding die is properly assembled, a melted resin is injected into the cavity from the injection gate in a known manner. Upon this, the melted resin is forced to flow or run in the cavity in a longitudinal direction toward various portions of the cavity. Once the resin in the cavity becomes sufficiently cured or hardened, the molding die is disassembled for releasing the product 1A from the molding die.

It is now to be noted that provision of the two elongate bead portions 12*a* and 12*b* of the product (viz., cylinder head cover 1A) means that the inner surface (or inner wall) of the cavity of the molding die is formed with two longitudinally extending elongate recesses by which the two elongate bead portions 12*a* and 12*b* are molded or produced under injection molding.

Thus, when the melted resin is injected into the cavity through the injection gate, the injected melted resin can smoothly flow or move to the desired portions of the cavity due to a so-called fluid guiding function possessed by the straightly extending two elongate recesses of the molding die. Due to this smooth flow of the melted resin in the cavity, undesired short-shot is suppressed, and thus, the cylinder head cover 1A can be precisely molded by the molding die without inducing molding defects.

As a result, as will be understood from FIG. 3, the thickness "t2" of the base part of the thicker lower portion of the flange part 3 can be reduced to the same level as the thickness "t1" of the general portion of the cover part 2, and furthermore, the thickness "W1" of the thicker lower part of the flange part 3 can be reduced to a desired reduced level. Furthermore, the thickness "t1" of the general portion of the cover part 2 can be reduced to a desired reduced level. Since the thicker bead portions 12*a* and 12*b* serve as reinforcing means, the produced cylinder head cover 1A can exhibit a satisfied mechanical strength.

In order to clarify the advantageous feature of the present invention, a conventional resin-made molded cylinder head cover 100 will be briefly discussed in the following.

Actually, the conventional cylinder head cover 100 was produced through a technique and split molding die that are disclosed in the above-mentioned publication (viz., Japanese Laid-open Patent Application (tokkai) 2007-154812).

Figure 6:
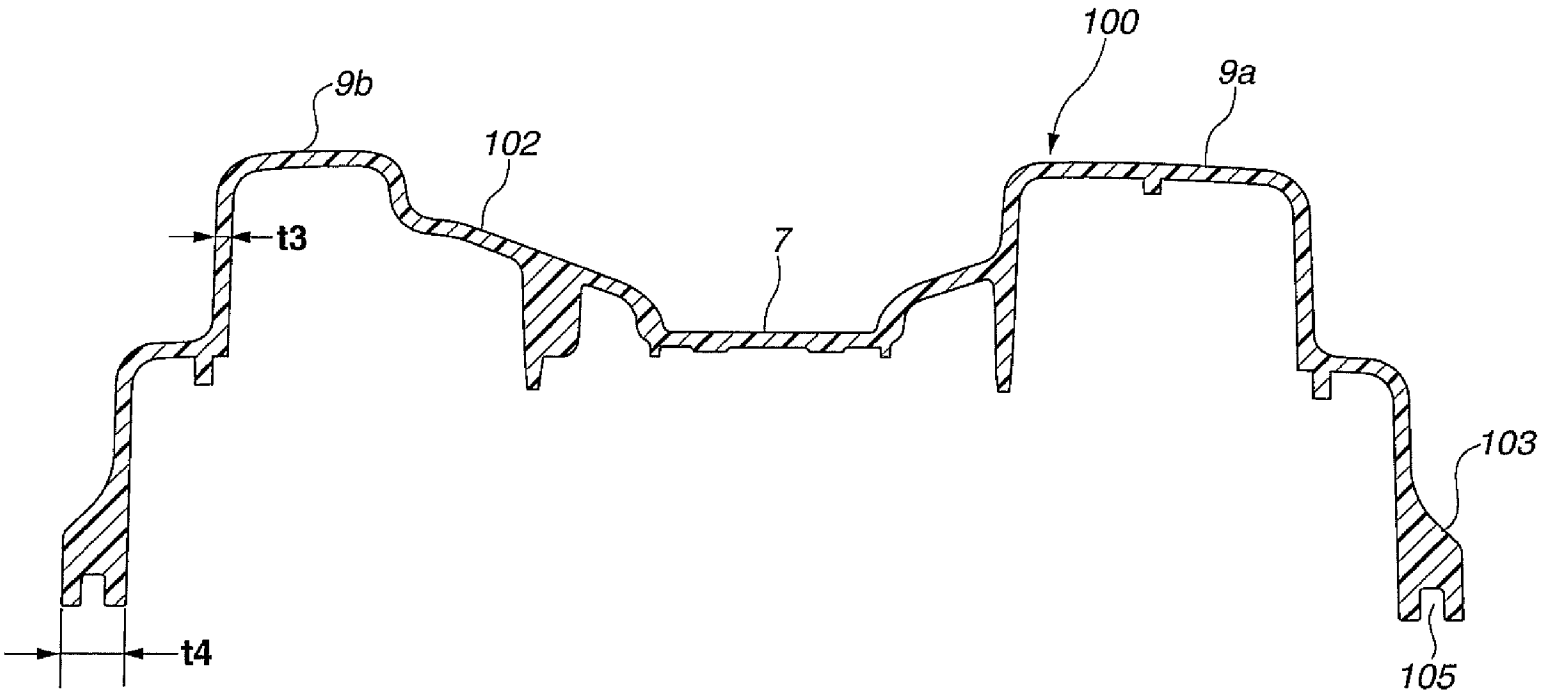
FIG.6 PRIOR ART
FIG. 6 is a sectional view of a conventional resin-made molded cylinder head cover as a reference example, which view corresponds to the view of FIG. 3.

Referring to FIG. 6, there is shown a sectional view of the conventional cylinder head cover 100 as a reference example, which view corresponds to the view of FIG. 3. Also in this reference example, the thicker lower portion of a flange part 103 has a gasket receiving groove 105 for tightly receiving therein a rectangular (or rectangularly extending) gasket (not shown) and the thickness "t4" of the thicker lower portion of the flange part 103 is larger than the thickness "t3" of a general portion of the cover part 102.

As will be understood when comparing FIG. 6 with FIG. 3, the thickness "t4" of the thicker lower portion of the flange part 103 of the conventional cylinder head cover 100 is larger than the thickness "W1" of the flange part 3 of the cylinder head cover 1A of the invention. Also in this reference example, when producing the cylinder head cover 100, the fluidity of melted resin in the cavity of a corresponding molding die depends largely on the size or thickness of a cavity portion of the molding die in which the flange part 103 is to be molded.

In order to examine the fluidity of a melted resin in the molding die cavity in case of the conventional cylinder head cover 100, the inventors conducted an experiment by using a split molding die sized and constructed to produce a conventional cylinder head cover 100 whose size is reduced to the level of the cylinder head cover 1A of the present invention. That is, the split molding die used for the experiment had no elongate recesses that correspond to the two elongate recesses by which the two bead portions 12*a* and 12*b* (see FIG. 3) of the invention are molded.

The experiment revealed that the fluidity of melted resin in the molding die cavity apparently lowered and undesired short-shot occurred. This means that the elongate recesses of the molding die by which the cylinder head cover 1A of the invention is molded contributes to improvement of fluidity of melted resin in the molding die cavity. Furthermore, it is considered that due to reduction in size of the cavity of the molding die by which the conventional cylinder head cover 100 is molded, the fluidity of the melted resin in the cavity is deteriorated.

While, in the present invention, as is mentioned hereinabove, due to provision of the two elongate recesses of the split molding die by which the two elongate bead portions 12*a* and 12*b* are molded, the injected melted resin can easily and smoothly flow in the cavity of the molding die and thus produce the cylinder head cover 1A without bringing about undesired short-shot.

The inventors found out that the thickness "t1" (see FIG. 3) of the general part of the cover part 2 of the cylinder head cover 1A of the invention was smaller than the thickness "t3" of the general part of the cover part 102 of the conventional cylinder head cover 100 by about 0.5 mm and the weight of the cylinder head cover 1A of the invention was lower than that of the examined conventional cylinder head cover 100 by about 20%.

Figure 7:
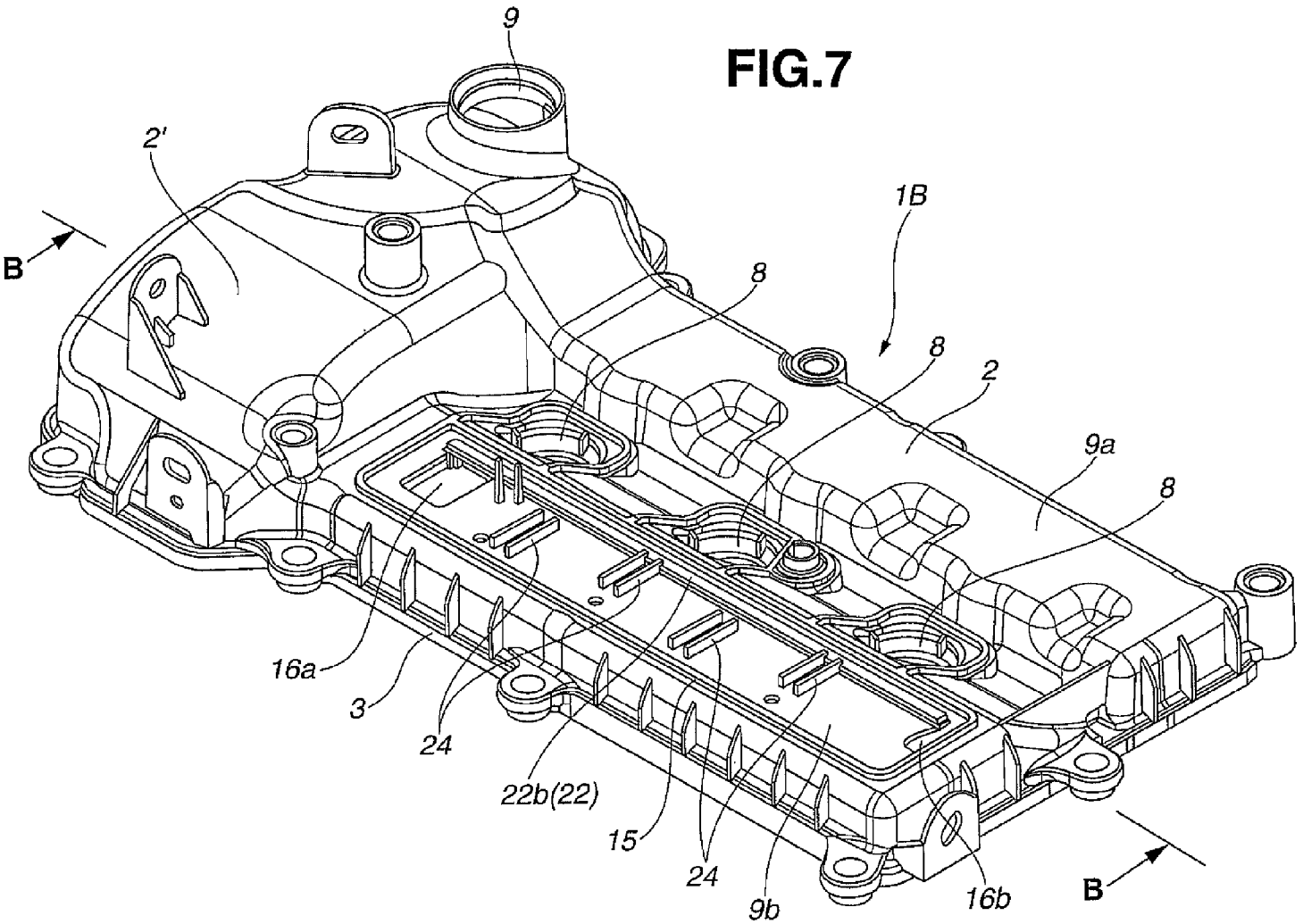
FIG. 7 is a perspective view of a resin-made molded cylinder head cover of a second embodiment of the present invention.
Figure 8:
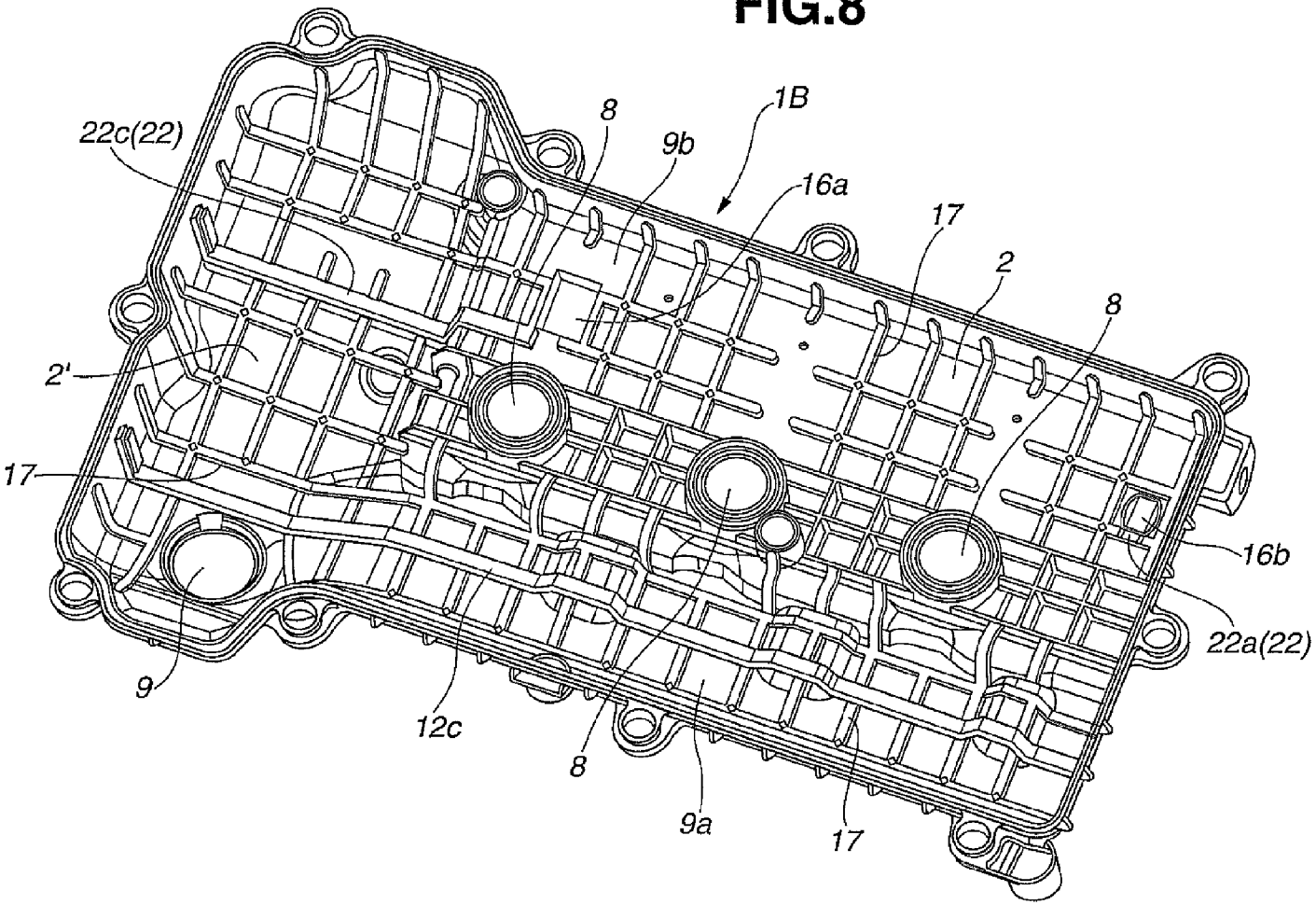
FIG. 8 is a bottom perspective view of the cylinder head cover of the second embodiment.

Referring to FIGS. 7 to 10, particularly FIGS. 7 and 8, there is shown a resin-made molded cylinder head cover 1B of a second embodiment of the present invention. In these drawings, similar parts to those of the above-mentioned first embodiment are denoted by the same numerals as those of the first embodiment.

Like the first embodiment, the cylinder head cover 1B of this second embodiment is constructed of a heat-resistant thermoplastic resin.

As is seen from FIG. 7, on one 9*b* of tunnel portions 9*a* and 9*b* of the cylinder head cover 113, there is integrally formed a rectangular (or rectangularly extending) bead portion 15, and at longitudinally spaced positions in an elongate area surrounded by the rectangular bead portion 15, there are formed respective openings 16*a* and 16*b* each being rectangular in shape.

Although not shown in the drawings, when in use, a rectangular cover of resin is secured to the rectangular bead portion 15 through vibration welding. With this, a so-called oil mist separator is produced using the two openings 16*a* and 16*b* as blowby gas inlet and outlet openings respectively. Denoted by numerals 24 are baffle ribs used for effectively separating oil mist in a blowby gas led into the oil mist separator from an internal combustion engine.

Figure 9:
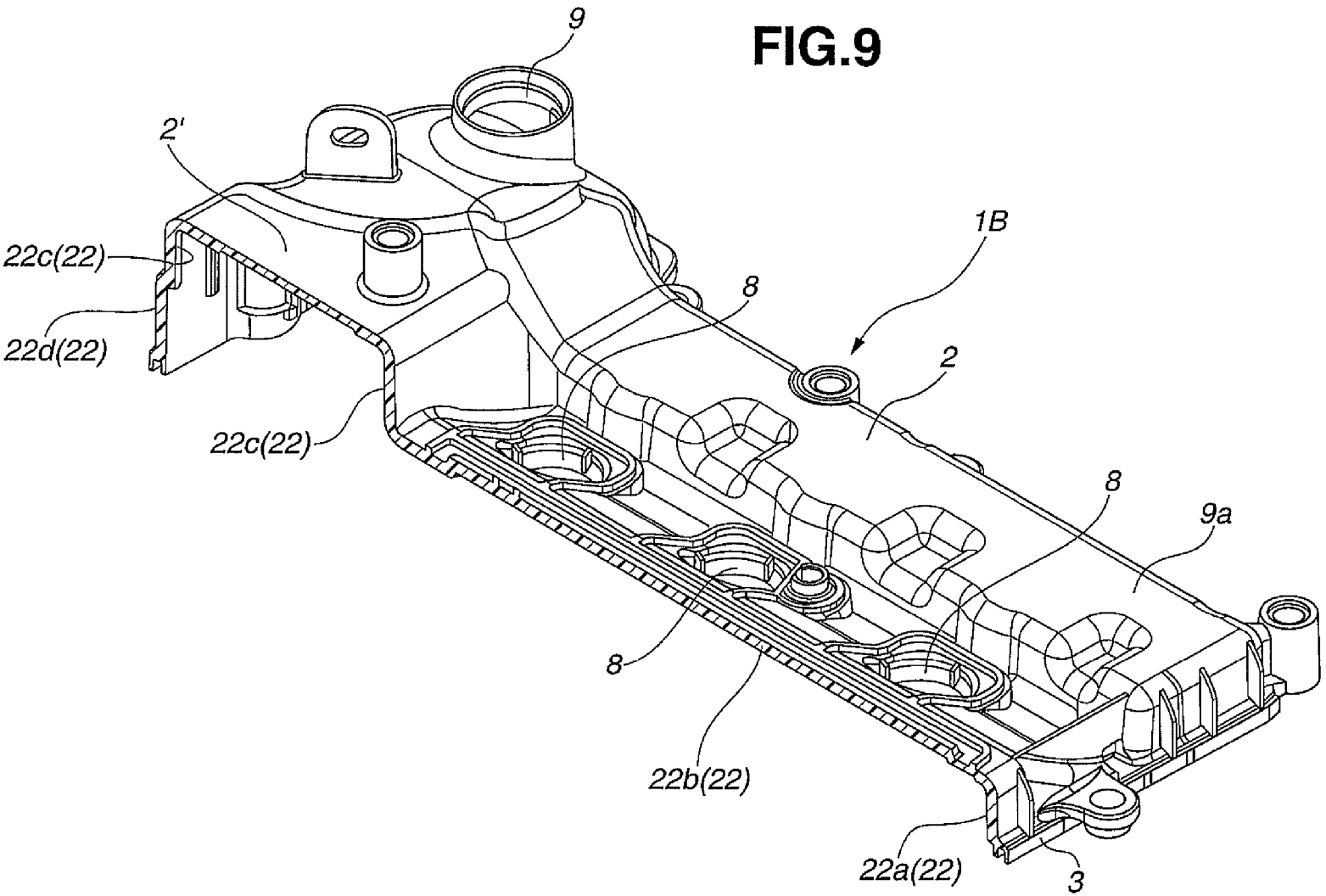
FIG. 9 is a perspective view of one half part that is provided when the cylinder head cover of the second embodiment is cut along the line "B-B" of FIG. 7.

As is seen from FIGS. 7 to 9, the cylinder head cover 1B is formed near the openings 16*a* and 16*b* with a thicker bead portion 22 that extends longitudinally on a cover part 2 of the cylinder head cover 1B.

Although the thicker bead portion 22 has substantially the same construction as the first bead portion 12*a* of the first embodiment, the following modification is employed in the thicker bead portion 22 of the second embodiment.

Figure 10:
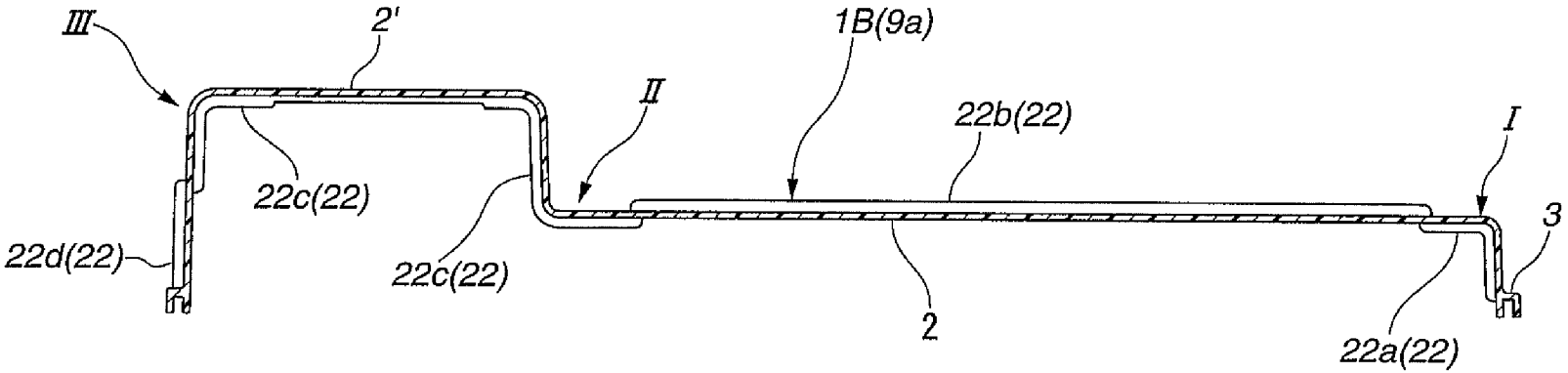
FIG. 10 is an enlarged sectional view of the cylinder head cover of the second embodiment, which is taken along a line that is slightly spaced from but parallel with the line "B-B" of FIG. 7.

That is, as will be understood from FIGS. 7, 8, 9 and 10, particularly FIG. 10, the direction in which the thicker bead portion 22 is projected (or raised) changes at three positions, which are first position "I" where the flange part 3 extends downward from one longitudinal end of the cover part 2, a second position "II" where the swollen portion 2' extends upward from the other longitudinal end of the cover part 2 and a third position "III" where a longitudinally outer wall of the swollen portion 2' extends downward from a ceiling part of the swollen portion 2'.

More specifically, the thicker bead portion 22 employed in this second embodiment comprises a first bead section 22*a* that is projected inward and extends along the flange part 3 near the first position "I", a second bead section 22*b* that is projected outward and extends throughout the cover part 2 from the first position "I" to the second position "II", a third bead section 22*c* that is projected inward and extends from the second position "II" to the third position "III" and a fourth bead section 22*d* that is projected outward and extends from the third position "III" to the other flange part 3, as shown.

Thus, the second and fourth bead sections 22*b* and 22*d* are exposed to the outside of the cylinder head cover 1B and the first and third bead sections 22*a* and 22*c* are exposed to the inside of the cylinder head cover 1B. In FIG. 7, the fourth bead section 22*d* is not seen due to obstruction by the swollen portion 2'.

It is to be noted that continuity and linearity of thicker bead portion 22 are kept by these four bead sections 22*a* to 22*d*.

Of course, the positions and size of the bead sections 22*a* to 22*d* are determined in view of easiness and certainty with which the produced cylinder head cover 1B can be removed or released from a corresponding split molding die.

The manner in which the bead sections 22*a* to 22*d* are projected will be easily understood from FIG. 9 that is a perspective view of one part that is provided when the cylinder head cover 1B is cut along the line "B-B" of FIG. 7.

As is seen from FIG. 8, on the inner surface of the cylinder head cover 1B (more specifically, on the inner surface of a ceiling of a tunnel portion 9*a*) at a position laterally opposite to the position where the above-mentioned thicker bead portion 22 is provided, there is integrally formed a longitudinally extending thicker bead portion 12*c* that is constructed to serve as the second elongate bead portion 12*b* of the first embodiment 1A.

Furthermore, as is seen from FIG. 8, on an entirely inner surface of the cylinder head cover 1B, there are integrally formed a plurality of reinforcing ribs 17 that are combined to constitute a lattices pattern and connected to the two thicker bead portions 22 and 12*c*.

Also in the second embodiment, an injected melted resin can smoothly flow in the molding die cavity due to provision of two longitudinally extending recesses of the die by which the two thicker beard portions 22 and 12*c* of the product (viz., cylinder head cover) 1B are to be molded, like in case of the first embodiment.

Due to provision of the two elongate thicker bead portions 22 and 12*c* (see FIG. 8) and the rectangularly extending bead portion 15 (see FIG. 7) and the plurality of reinforcing ribs 17 (see FIG. 8), the cylinder head cover 1B of the second embodiment can have an increased mechanical strength like in case of the cylinder head cover 1A of the first embodiment. Furthermore, since, in the second embodiment, the thicker bead portion 22 is not projected into the tunnel portion 9*b* (see FIG. 8), the tunnel portion 9*b* can provide an associated camshaft (not shown) with a smoothed or projection-free receiving area.

The entire contents of Japanese Patent Application 2013-036611 filed Feb. 27, 2013 are incorporated herein by reference.

Although the invention has been described above with reference to embodiments of the invention, the invention is not limited to such embodiments as described above. Various modifications and variations of such embodiments may be carried out by those skilled in the art, in light of the above description.

What is claimed is:

1. A resin-made molded cylinder head cover for an internal combustion engine, comprising: a cover part that is rectangular in shape comprising: a longitudinally extending center area, and tunnel portions extending along laterally opposed sides of the center area, the tunnel portions each having an inner surface comprising a ceiling and laterally opposed side walls, wherein the cover part has a plurality of plug holes aligned in the center area of the cover part; a flange part that is integral with and extends around a periphery of the cover part, so that the cylinder head cover has a rectangular dish shape; and thicker elongate bead portions that are integral with the cover part and longitudinally extend respectively along laterally opposed sides of the center area, each bead portion being thicker than a general portion of the cover part, wherein the thicker elongate bead portions comprise a solid belt shape that projects from a surface of the cover part, and wherein at least one of the thicker elongate bead portions is integrally formed along a center of the ceiling of one of the tunnel portions.

2. A resin-made molded cylinder head cover as claimed in claim 1, in which the thicker elongate bead portions are projected elongate portions that are entirely formed on an inner surface of the cover part.

3. A resin-made molded cylinder head cover as claimed in claim 1, in which at least one of the thicker elongate bead portions has a projected elongate section that is formed on an inner surface of the cover part.

4. A resin-made molded cylinder head cover as claimed in claim 1, further comprising reinforcing ribs that are integrally formed on an inner surface of the cover part to reinforce the cover part.

5. A resin-made molded cylinder head cover as claimed in claim 1, in which the number of the thicker elongate bead portions is two and the two thicker elongate bead portions extend along the laterally opposed sides of the longitudinally extending center area of the cover part respectively.

6. A resin-made molded cylinder head cover as claimed in claim 1, wherein the resin-made molded cylinder head cover is produced by injecting melted resin into a cavity of a split molding die from an injection gate so that the injected melted resin can smoothly flow or move to desired portions of the cavity due to longitudinally extending elongate recesses of the molding die resulting in the thicker elongate bead portions.

7. A resin-made molded cylinder head cover as claimed in claim 1, wherein the flange part further comprises a lower portion, the lower portion including base parts configured to receive a gasket therein, wherein the lower portion has a width larger than a thickness of the general portion of the cover part, and wherein at least one of the base parts has a thickness substantially the same as a thickness of the general portion.

8. A resin-made molded cylinder head cover as claimed in claim 1, further comprising a rectangular bead portion that longitudinally extends along a lateral side of the center area and surrounds an elongate area of a surface of the cover part.

9. A resin-made molded cylinder head cover as claimed in claim 3, in which one of the thicker elongate bead portions is a projected elongate portion that is entirely formed on an inner surface of the cover part, and another one of the thicker elongate bead portions comprises a first projected elongate section formed on an inner surface of the cover part and a second projected elongate section formed on an outer surface of the cover part.

10. A resin-made molded cylinder head cover as claimed in claim 9, in which the first and second projected elongate sections are arranged to keep a continuity in a longitudinal direction.

11. A resin-made molded cylinder head cover as claimed in claim 4, in which the reinforcing ribs are integrally connected to the thicker elongate bead portions.

12. A resin-made molded cylinder head cover as claimed in claim 11, wherein the reinforcing ribs are integrally formed on the flange part and the side walls of the tunnel portions.

13. A resin-made molded cylinder head cover as claimed in claim 11, wherein the reinforcing ribs are integrally connected to the thicker elongate bead portions through a plurality of small ribs.

14. A resin-made molded cylinder head cover as claimed in claim 8, wherein each of the widths of the thicker elongate bead portions is greater than a width of the rectangular bead portion.

15. A resin-made molded cylinder head cover for an internal combustion engine, comprising: a cover part that is rectangular in shape comprising: a longitudinally extending center area, and tunnel portions extending along laterally opposed sides of the center area, the tunnel portions each having an inner surface comprising a ceiling and laterally opposed side walls, wherein the cover part has a plurality of plug holes aligned in the center area of the cover part; a flange part that is integral with and extends around a periphery of the cover part, so that the cylinder head cover has a rectangular dish shape; a plurality of reinforcing ribs that are integrally formed on an inner surface of the cover part; and thicker elongate bead portions that are integral with the cover part and longitudinally extend respectively along laterally opposed sides of the center area, each bead portion being thicker than a general portion of the cover part, wherein the thicker elongate bead portions comprise a solid belt shape that projects from a surface of the cover part, wherein the thicker elongate bead portions are projected elongate portions that are entirely formed on the ceilings of the tunnel portions, and wherein the plurality of reinforcing ribs are integrally connected to the thicker elongate bead portions through a plurality of small ribs.

16. A resin-made molded cylinder head cover as claimed in claim 15, in which the number of the thicker elongate bead portions is two and the two thicker elongate bead portions extend respectively along laterally opposed sides of the longitudinally extending center area.

17. A resin-made molded cylinder head cover for an internal combustion engine, comprising: a cover part that is rectangular in shape comprising: a longitudinally extending center area, and tunnel portions extending along laterally opposed sides of the center area, the tunnel portions each having an inner surface comprising a ceiling and laterally opposed side walls, wherein the cover part has a plurality of plug holes aligned in the center area of the cover part; a flange part that is integral with and extends around a periphery of the cover part, so that the cylinder head cover has a rectangular dish shape; a plurality of reinforcing ribs that are integrally formed on an inner surface of the cover part; and thicker elongate bead portions that are integral with the cover part and longitudinally extend respectively along laterally opposed sides of the center area, each bead portion being thicker than a general portion of the cover part, wherein the thicker elongate bead portions comprise a solid belt shape that projects from a surface of the cover part, and wherein one of the thicker elongate bead portions is a projected elongate portion that is entirely formed on the ceiling of one of the tunnel portions and the plurality of reinforcing ribs are integrally connected to the one of the thicker elongate bead portions through a plurality of small ribs, and another one of the thicker elongate bead portions comprises a first projected elongate section formed on the inner surface of the cover part and a second projected elongate section formed on an outer surface of the cover part.

18. A resin-made molded cylinder head cover as claimed in claim 17, in which the number of the thicker elongate bead portions is two and one of the two thicker elongate bead portions is the projected elongate portion that is entirely formed on the ceiling of one of the tunnel portions and integrally connected to the plurality of reinforcing ribs through the plurality of small ribs, and the other of the two thicker elongate bead portions comprises the first projected elongate section formed on the inner surface of the cover part and the second projected elongate section formed on the outer surface of the cover part.

* * * * *